US009173273B2

(12) United States Patent
Zudrell-Koch et al.

(10) Patent No.: US 9,173,273 B2
(45) Date of Patent: Oct. 27, 2015

(54) SOLID STATE LIGHTENING DRIVER WITH MIXED CONTROL OF POWER SWITCH

(71) Applicant: Dialog Semiconductor GmbH, Kirchhheim/Teck-Nabern (DE)

(72) Inventors: Stefan Zudrell-Koch, Kirchheim am Neckar (DE); Nebojsa Jelaca, Graz (AT)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 42 days.

(21) Appl. No.: 13/748,039

(22) Filed: Jan. 23, 2013

(65) Prior Publication Data

US 2014/0055052 A1 Feb. 27, 2014

(51) Int. Cl.

| | |
|---|---|
| ***H05B 33/08*** | (2006.01) |
| ***H05B 37/02*** | (2006.01) |
| ***H05B 41/34*** | (2006.01) |

(52) U.S. Cl.

CPC ..... *H05B 37/02* (2013.01); *H05B 33/0815* (2013.01); *H05B 41/34* (2013.01); *H05B 33/0803* (2013.01)

(58) Field of Classification Search

CPC ..... H05B 41/34; H05B 33/0803; H05B 39/09
USPC ..... 315/200 R, 171, 179
See application file for complete search history.

(56) References Cited

U.S. PATENT DOCUMENTS

| | | | | |
|---|---|---|---|---|
| 8,716,957 | B2 * | 5/2014 | Melanson et al. | 315/360 |
| 8,742,684 | B2 * | 6/2014 | Melanson | 315/291 |
| 2010/0156319 | A1 * | 6/2010 | Melanson | 315/297 |
| 2010/0213859 | A1 * | 8/2010 | Shteynberg et al. | 315/224 |
| 2012/0112638 | A1 * | 5/2012 | Melanson et al. | 315/117 |
| 2012/0286684 | A1 * | 11/2012 | Melanson et al. | 315/224 |
| 2014/0055052 | A1 * | 2/2014 | Zudrell-Koch et al. | 315/200 R |
| 2014/0159608 | A1 * | 6/2014 | Simi et al. | 315/205 |
| 2015/0035446 | A1 * | 2/2015 | Yamahara et al. | 315/210 |
| 2015/0035453 | A1 * | 2/2015 | Seki et al. | 315/294 |

FOREIGN PATENT DOCUMENTS

| | | |
|---|---|---|
| DE | 102005018795 | 10/2006 |
| EP | 12181730.8 | 1/2013 |
| WO | WO2008023341 | 2/2008 |
| WO | WO2010011971 | 1/2010 |
| WO | WO2012007798 | 1/2012 |

* cited by examiner

*Primary Examiner* — Dylan White

(74) *Attorney, Agent, or Firm* — Saile Ackerman LLC; Stephen B. Ackerman

(57) ABSTRACT

In order to control of dimming of solid state lighting devices (SSL) a driver circuit drives the SSL subject to an input voltage using a phase-cut dimmer. The driver circuit comprises a transistor operable in two modes, either alternating between on/off states or continuously controlling a current through the transistor. A power converter network provides a switched-mode power converter in conjunction with the transistor when operated in the first mode generating a drive voltage for the SSL. The control unit controls the transistor to selectively operate in one of the two modes; to control the transistor to determine that the input voltage exceeds an input voltage threshold; and to control a drive current through the SSL based on a measurement of a phase-cut angle thereby controlling an illumination level of the SSL device.

26 Claims, 7 Drawing Sheets

SOLID STATE LIGHTENING DRIVER WITH MIXED CONTROL OF POWER SWITCH

TECHNICAL FIELD

Figure 1:
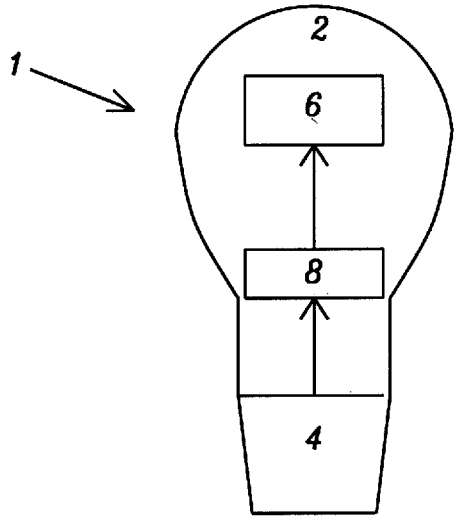

The present document relates to illumination systems. In particular, the present document relates to a method and system for controlling the degree of dimming of solid state lighting devices such as LED or OLED assemblies

BACKGROUND

For many decades GLS (General Lighting Service) or incandescent lamps have been the first choice for illumination in residential applications. These light sources could easily be dimmed using so called phase-cut dimmers. This has led to a large installed base of such dimmers. These dimmers are designed to work on relatively large loads with a substantial effective power over apparent power.

New types of light sources like CFL (Compact Fluorescent Lamp) or LED lamps offer very small loads (typical a factor of 10 less than the equivalent GLS lamp) in combination with a highly nonlinear behavior and a large capacitive impedance due to the presence of EMI (Electro-Magnetic Interference) filter networks. Due to these aspects, LED based lamp and CFL assemblies cannot be dimmed inherently using existing phase-cut dimmers. With advanced electronics it is possible to emulate dimming functionality. However, due to technical/physical limitations, the dimming range as well as the range of supported dimmers and configurations in terms of the number and mix of parallel lamps operated with a particular dimmer is limited. Furthermore, the additional circuits typically lead to increased costs and, in most cases, to additional power losses in the lamp assemblies.

The present document addresses the above mentioned problems. In particular, the present document describes a method and system which allow for a reliable determination of the phase of a mains power submitted to a phase-cut dimmer, thereby reliably and efficiently controlling the illumination of a Solid State Lightening (SSL) lamp

SUMMARY OF THE DISCLOSURE

A principal object of the present disclosure is to reliably and efficiently control illumination of a Solid State Lightening (SSL) lamp.

A further principal object of the present disclosure is to reliably determine a phase of a mains power submitted to a phase-cut dimmer.

A further object of the disclosure is to achieve a control unit for a driver circuit which is configured to drive a SSL, e.g. an LED or an OLED.

A further object of the disclosure is to generate a drive voltage/current subject to an input voltage, which is derived from a mains voltage using a phase-cut dimmer . . . .

A further object of the disclosure is to use one or more power switches of the power converter for charging the supply voltage capacitor.

A further object of the disclosure is to have the control unit operable in a first mode, in which a transistor is alternating between an ON-state and an OFF-state at a commutation cycle rate, and a second mode the transistor is controlled so that it is traversed by a continuously controllable current, thereby providing a controlled load to the mains voltage.

In accordance with the objects of this disclosure control unit for a driver circuit which is configured to drive a solid state lightening, referred to as SSL device, subject to an input voltage derived from a mains voltage using a phase-cut dimmer, wherein the driver circuit comprises a transistor operable in a first mode and in a second mode; and a power converter network has been disclosed. The control unit disclosed is configured to control the transistor to selectively operate in the first and second mode; wherein in the first mode, the transistor alternates between an on-state and an off-state at a commutation cycle rate, thereby providing a switched-mode power converter in conjunction with the power converter network; wherein in the second mode, the transistor is controlled so that it is traversed by a controlled current, thereby providing a controlled load to the mains voltage In accordance with the objects of this disclosure a driver circuit for driving a solid state lightening, referred to as SSL, device, subject to an input voltage derived from a mains voltage using a phase-cut dimmer. The driver circuit comprises a transistor operable in a first mode and in a second mode; wherein in the first mode, the transistor alternates between an on-state and an off-state at a commutation cycle rate; wherein in the second mode, the transistor is traversed by a current at a smoothly controllable level, a power converter network configured to provide a switched-mode power converter in conjunction with the transistor when operated in the first mode; wherein the power converter generates a drive voltage for the SSL device from the input voltage, and a control unit configured to control the transistor to selectively operate in the first and second mode; wherein in the first mode, the transistor alternates between an on-state and an off-state at a commutation cycle rate, thereby providing a switched-mode power converter in conjunction with the power converter network; wherein in the second mode, the transistor is controlled so that it is traversed by a controlled current, thereby providing a controlled load to the mains voltage.

In accordance with the objects of this disclosure a light bulb assembly has been disclosed. The light bulb assembly firstly comprises an electrical connection module configured to electrically connect to a mains voltage submitted to a phase-cut dimmer, thereby providing an input voltage and a driver circuit configured to provide a drive voltage and a drive current in accordance to a setting of the phase-cut dimmer, based on the input voltage, wherein the driver circuit comprises a transistor operable in a first mode and in a second mode; wherein in the first mode, the transistor alternates between an on-state and an off-state at a commutation cycle rate; wherein in the second mode, the transistor is traversed by a current at a smoothly controllable level, a power converter network configured to provide a switched-mode power converter in conjunction with the transistor when operated in the first mode; wherein the power converter generates a drive voltage for the SSL device from the input voltage, and a control unit wherein the control unit is configured to control the transistor to selectively operate in the first and second mode; wherein in the first mode, the transistor alternates between an on-state and an off-state at a commutation cycle rate, thereby providing a switched-mode power converter in conjunction with the power converter network; wherein in the second mode, the transistor is controlled so that it is traversed by a controlled current, thereby providing a controlled load to the mains voltage. Furthermore the light bulb assembly comprises a SSL device configured to provide light at an illumination level in accordance to the drive voltage and drive current.

In accordance with the objects of this disclosure a method to allow a reliable determination of the phase of a mains power submitted to a phase-cut dimmer, thereby reliably and efficiently controlling the illumination of a Solid State Lightening (SSL) lamp has been achieved. The method comprises the steps of: providing a control unit, a driver circuit comprising a single power switch, and a SSL device, wherein the driver circuit is setting an illumination level of the SSL device in accordance to a setting of the phase-cut dimmer, measuring a phase-cut-angle set by the phase-cut dimmer by using the single power switch, translating measured setting of the phase-cut dimmer into a drive voltage and a drive current driving the SSL device by using the single switch for power conversion, and sensing current through the power switch to determine a feedback signal indicative of the level of the current through the SSL in order to control the current.

According to an aspect, a control unit for a driver circuit is described. The driver circuit may be configured to drive a solid state lightening (SSL), e.g. an LED and/or and OLED, device. For this purpose, the driver circuit may generate a drive voltage and/or a drive current for the SSL device. The drive voltage and/or the drive current may be generated subject to an input voltage which is derived from a mains voltage using a phase-cut dimmer. As such, the input voltage to the driver circuit may correspond to a mains voltage which has been modified by a phase-cut dimmer (e.g. a leading edge and/or a tailing edge phase-cut dimmer).

The driver circuit for which the claimed control unit may be used typically comprises a switch (e.g. a transistor) which is operable in a first mode and in a second mode. The switch may be sequentially operated in the first mode and in the second mode. In particular, the switch may be operable either in the first mode or in the second mode. In the first mode, the switch may alternate between an on-state and an off-state at a commutation cycle rate. In the second mode, the switch may be controlled so that it is traversed by a current at a continuously controllable level. In other words in the second mode, the level of the current through the switch may be controllable in a continuous and/or smooth manner. In this context, the term "continuous" should be understood in its mathematical meaning, thereby distinguishing the second mode from the discrete or discontinuous operation within the first mode. The switch may comprise (or may be) a transistor, e.g. a MOSFET, a BJT or an IGBT. The first mode may be referred to as an on/off mode and the second mode may be referred to as a linear mode (because the switch may be operated within its linear region).

In addition, the driver circuit for which the claimed control unit may be used typically comprises a power converter network configured to provide a switched mode power converter in conjunction with the switch when operated in the first mode. The power converter may generate the drive voltage for the SSL device from the input voltage. In order to control the level of the drive voltage, the commutation cycle rate and/or a duty cycle of the switch may be controlled (e.g. by the control unit).

The control unit may be configured to control the switch to selectively operate in the first and second mode. By way of example, the control unit may control the switch to alternate between the first and the second mode. For this purpose, the control unit may comprise a mode selector configured to selectively couple the switch to a first control signal generation unit generating a first control signal for operating the switch in the first mode, and to a second control signal generation unit generating a second control signal for operating the switch in the second mode.

The control unit may be configured to control the transistor to operate in the first mode. The control may be such that, in the first mode, the transistor alternates between an on-state and an off-state at a commutation cycle rate, thereby providing a switched-mode power converter in conjunction with the power converter network. Furthermore, the control unit may be configured to control the transistor to operate in the second mode. The control may be such that, in the second mode, the transistor is controlled so that it is traversed by a controlled current, thereby providing a controlled load to the mains voltage. In other words, the transistor may be controlled such that the transistor has a controlled source-drain current as a controlled current level. The controlled current through the transistor may be a controlled load to the mains voltage. In particular, the control unit may be configured to control the switch to operate in the second mode at a first time instant (e.g. to change from the first mode to the second mode at the first time instant). Furthermore, the control unit may be configured to determine that the input voltage exceeds a pre-determined input voltage threshold at a second time instant, subsequent to the first time instant.

The control unit typically controls the switch to operate in the second mode in the time interval starting with the first time instant and ending with the second time instant. This time interval may be indicative of a phase-cut angle set by the phase-cut dimmer. In other words, the first and the second time instants may be indicative of the phase-cut angle set by the phase-cut dimmer. As a consequence, the control unit may be configured to control the drive current through the SSL device based on the first and second time instants, thereby controlling an illumination level of the SSL device.

It should be noted that as a result of operating the single switch in at least two different modes (i.e. the first and second modes), the control unit typically comprises only a single pin for providing the control signal to the single switch of the driver circuit. As a result, the number of pins of the control unit can be reduced compared to a control unit controlling at least two different switches which are operated in the at least two different modes, respectively.

The driver circuit may further comprise current sensing means configured to determine a feedback signal indicative of the level of the current through the switch. By way of example, the current sensing means may comprise a sensing resistor which is arranged in series with the switch. The feedback signal may correspond to the voltage drop across the sensing resistor, wherein the voltage drop across the sensing resistor is typically proportional to the current through the switch. The control unit may comprise a pin for receiving the feedback signal. Furthermore, the control unit may be configured to control the level of the current through the switch, when in the second mode, based on the feedback signal. By controlling the current through the switch, the control unit may provide overstress protection of the components of the driver circuit and/or of the control unit (by limiting the current through the switch to a value below a maximum current). Furthermore, the control unit may ensure that the components of the driver circuit are discharged within a pre-determined discharging time interval (by ensuring that the current through the switch exceeds a minimum current). In particular, it may be ensured that the components of the driver circuit are discharged prior to the second time instant (when the phase-cut dimmer goes into its on-state). As a result, the re-increase of the input voltage (due to the dimmer going into its on-state) can be reliably detected by the control unit.

The control unit may be configured to determine that the input voltage exceeds a pre-determined input voltage threshold (i.e. that the phase-cut dimmer goes into its on-state) by monitoring the input voltage (or a voltage derived from the input voltage, or a voltage derived from the mains voltage). For this purpose, the control unit may comprise an input voltage pin. The input voltage pin may be linked to input voltage measurement means of the driver circuit. The input voltage measurement means may e.g. be a voltage divider configured to provide a voltage derived from the input voltage to the input voltage pin of the control unit. The input voltage measurement means may be coupled to a rectifier unit of the driver circuit, on one side, and to the input voltage pin of the control unit on the other side. As such, the control unit may be configured to receive a voltage derived from the input voltage.

Furthermore, the control unit may be configured to determine that the input voltage exceeds a pre-determined input voltage threshold by determining that the received voltage exceeds a respective pre-determined threshold—

The control unit may be configured to determine an indicator of a phase-cut angle set by the dimmer based on the time interval between the first and second time instants. In particular, the control unit may be configured to determine the illumination level corresponding to the phase-cut angle (or corresponding to the time interval). The control unit may be configured to store data derived from the first and/or second time instants, wherein the data may be e.g. the time interval between the first and second time instants and/or the determined indicator of the phase-cut angle and/or the determined illumination level. Furthermore, the control unit may be configured to control the drive current to the SSL device such that the determined illumination level is provided by the SSL device. The driver circuit may comprise a current source and the control unit may be configured to control the current source to provide the appropriate drive current for the determined illumination level.

The mains voltage may be an alternating voltage at a mains frequency (e.g. at 50 or 60 Hz). The control unit may be configured to synchronize with the mains voltage. If the phase-cut dimmer is a leading edge phase-cut dimmer, then the first time instant may correspond to a zero-crossing of the mains voltage. On the other hand, if the phase-cut dimmer is a tailing edge phase-cut dimmer, then the second time instant may correspond to a zero-crossing of the mains voltage. As such, the control unit may be configured to select the first and/or second time instants based on the periodicity of the mains voltage.

The control unit may be configured, e.g. during a startup phase, to operate the switch in the second mode for at least two half-waves of the mains voltage. Furthermore, the control unit may be configured to determine a time interval during which the input voltage is below the pre-determined input voltage threshold (e.g. using the above mentioned schemes). In case there is a plurality of time intervals during which the input voltage is below the pre-determined input voltage threshold, then the control unit may be configured to determine the longest of the plurality of time intervals. An edge of the determined (longest) time interval may correspond to a zero-crossing of the mains voltage. By way of example, in case of a leading edge phase-cut dimmer, the earlier edge of the determined time interval may correspond to a zero-crossing of the mains voltage; whereas in case of a tailing edge phase-cut dimmer, the later edge of the determined time interval may correspond to a zero-crossing of the mains voltage. By doing this, the control unit may synchronize with the mains voltage.

It should be noted that the control unit may be configured to synchronize with the mains voltage based on the voltage provided at an input voltage pin of the control unit. As outlined above, the voltage provided at the input voltage pin of the control unit may be derived from the input voltage using input voltage measurement means.

As indicated above, the mains voltage may be an alternating voltage at a mains frequency. The control unit may be configured to periodically put the switch in the second mode at a measurement frequency. The measurement frequency may be selected to be smaller than the mains frequency. As a result of reducing the measurement frequency, losses of the driver circuit incurred when operating the switch in the second mode may be reduced. By way of example, the measurement frequency may be at or below 1/10 or 1/100 of the mains frequency.

As indicated above, the switch may comprise a transistor, e.g. a MOSFET, a BJT or an IGBT. Furthermore, the control unit may be configured to generate a control 20 signal to operate the switch in the first and/or second mode. The control signal may be gate voltage applied to a gate of the switch/transistor.

According to another aspect, a driver circuit is described. The driver circuit may be configured for driving a solid state lightening (SSL) device, subject to an input voltage derived from a mains voltage using a phase-cut dimmer. As indicated above, the driver circuit may comprise a switch operable in a first mode and in a second mode. In the first mode, the switch may alternate between an on-state and an off-state at a commutation cycle rate. In the second mode, the switch may be traversed by a current at a smoothly controllable level. Furthermore, the driver circuit may comprise a power converter network configured to provide a switched-mode power converter in combination with the switch when the switch is operated in the first mode. The power converter may generate a drive voltage for the SSL device from the input voltage. In addition, the driver circuit may comprise a control unit comprising any one or more of the features described in the present document.

The power converter network may comprise a flyback network, a buck network and/or a SEPIC network. The drive voltage provided by the power converter may be maintained at least at an on-voltage of the SSL device. In particular, the control unit may be configured to control the switch in the first mode such that the power converter maintains the drive voltage at least at the on-voltage of the SSL device. Furthermore, the driver circuit may comprise a current source arranged in series with the SSL device and coupled to the SSL device. The current source may be configured to provide the drive current for setting an illumination level of the SSL device, subject to the control of the control unit.

The driver circuit may further comprise a rectifier unit (e.g. comprising a half wave or full-wave rectifier) configured to rectify the input voltage. Furthermore, the driver circuit may comprise a stabilizing capacitor configured to stabilize the rectified input voltage to yield a voltage at an input of the power converter network. The switch may be configured to discharge the stabilizing capacitor when operated in the second mode. The discharging speed may be controlled by the level of the current through the switch, i.e. the discharging speed may be controlled by the control unit using the control signal, based on the feedback signal.

According to a further aspect, a light bulb assembly is described. The light bulb assembly comprises an electrical connection module configured to electrically connect to mains voltage submitted to a phase-cut dimmer, thereby providing an input voltage. Furthermore, the light bulb assembly comprises a driver circuit comprising any one or more of the features described in the present document. The driver circuit is configured to provide a drive voltage and a drive current in accordance to a setting of the phase-cut dimmer, based on the input voltage. The setting of the phase-cut dimmer may correspond to a phase-cut angle set by the phase-cut dimmer. In addition, the light bulb assembly may comprise an SSL device (e.g. a plurality of LEDs or OLEDs) configured to provide light at an illumination level in accordance to the drive voltage and drive current.

According to another aspect, a method for controlling a driver circuit is described. The driver circuit may be configured to drive a solid state lightening (SSL) device, subject, to an input voltage derived from a mains voltage using a phase-cut dimmer. As indicated above, the driver circuit may comprise a switch operable in a first mode and in a second mode. In the first mode, the switch may alternate between an on-state and an off-state at a commutation cycle rate. In the second mode, the switch may be controlled so that it is traversed by a current at a continuously controllable level. Furthermore, the driver circuit may comprise a power converter network configured to provide a switched-mode power converter in conjunction with the switch when operated in the first mode. The power converter may be configured to generate a drive voltage for the SSL device from the input voltage.

The method may comprise controlling the switch to selectively operate in the first and second mode. Furthermore, the method may comprise controlling the switch to change from the first mode to the second mode at a first time instant. The method may proceed in determining that the input voltage exceeds a predetermined input voltage threshold at a second time instant, subsequent to the first time instant (e.g. while the switch is still operated in the second mode). In addition, the method may comprise controlling a drive current through the SSL device based on the first and second time instants, thereby controlling an illumination level of the SSL device. According to a further aspect, a software program is described. The software program may be adapted for execution on a processor and for performing the method steps outlined in the present document when carried out on the processor.

According to another aspect, a storage medium is described. The storage medium may comprise a software program adapted for execution on a processor and for performing the method steps outlined in the present document when carried out on the processor.

According to a further aspect, a computer program product is described. The computer program may comprise executable instructions for performing the method steps outlined in the present document when executed on a computer.

It should be noted that the methods and systems including its preferred embodiments as outlined in the present document may be used stand-alone or in combination with the other methods and systems disclosed in this document. Furthermore, all aspects of the methods and systems outlined in the present document may be arbitrarily combined. In particular, the features of the claims may be combined with one another in an arbitrary manner.

In the present document, the term "couple" or "coupled" refers to elements being in electrical communication with each other, whether directly connected e.g., via wires, or in some other manner.

SHORT DESCRIPTION OF THE FIGURES

Figure 2A:
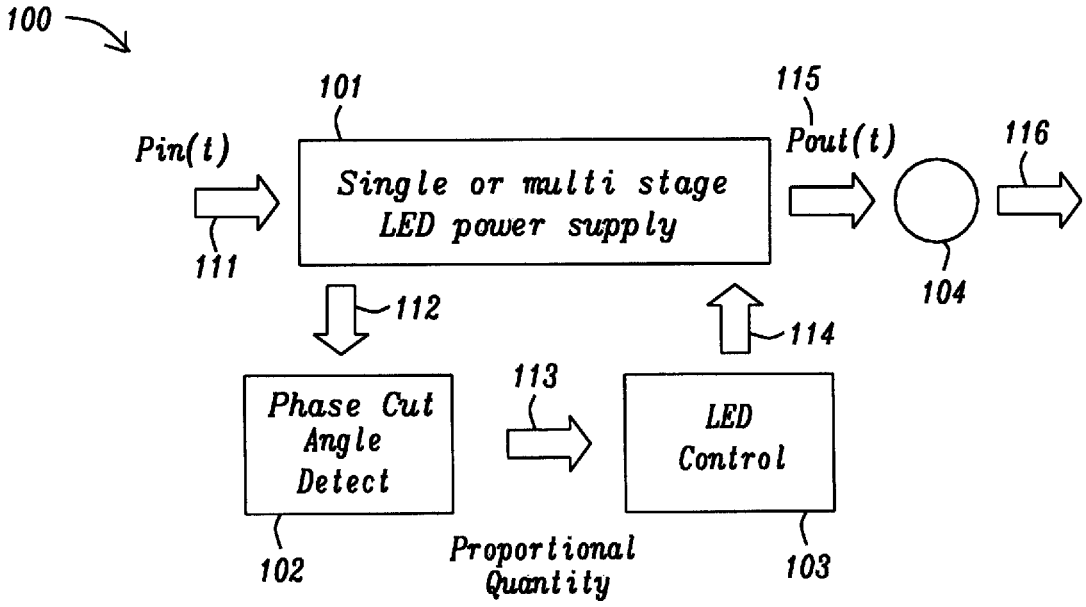
Figure 2B:
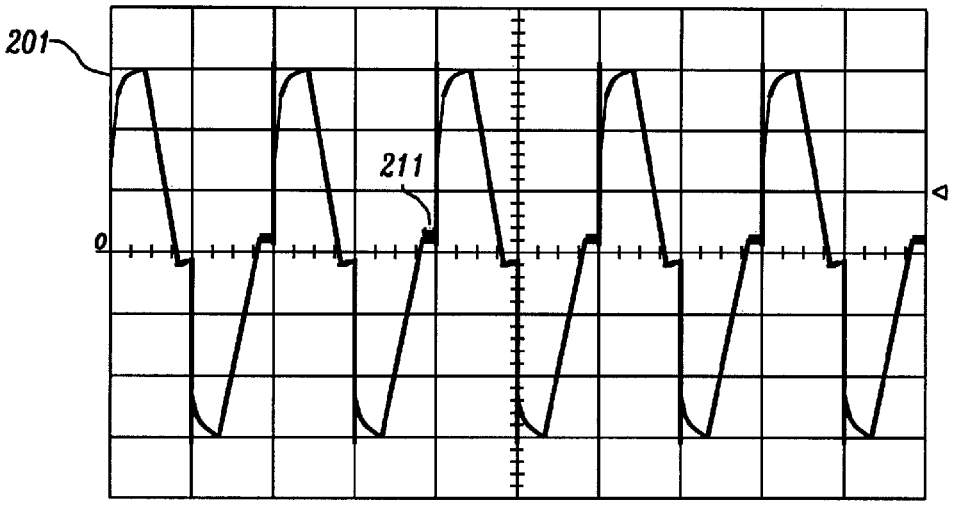
Figure 2C:
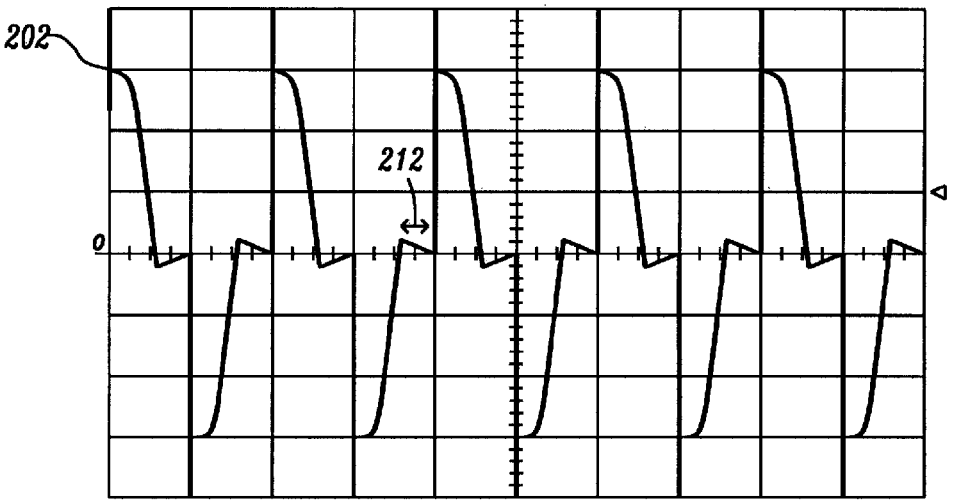
Figure 2D:
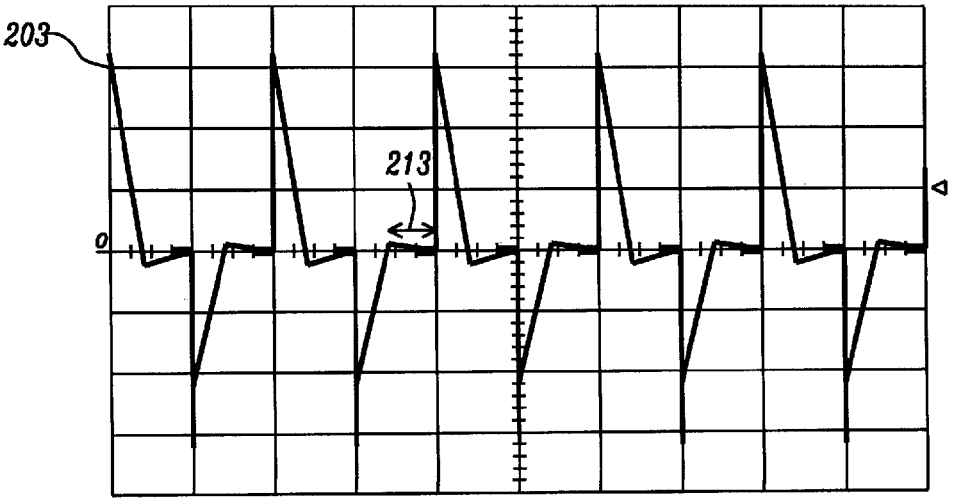
Figure 3A:
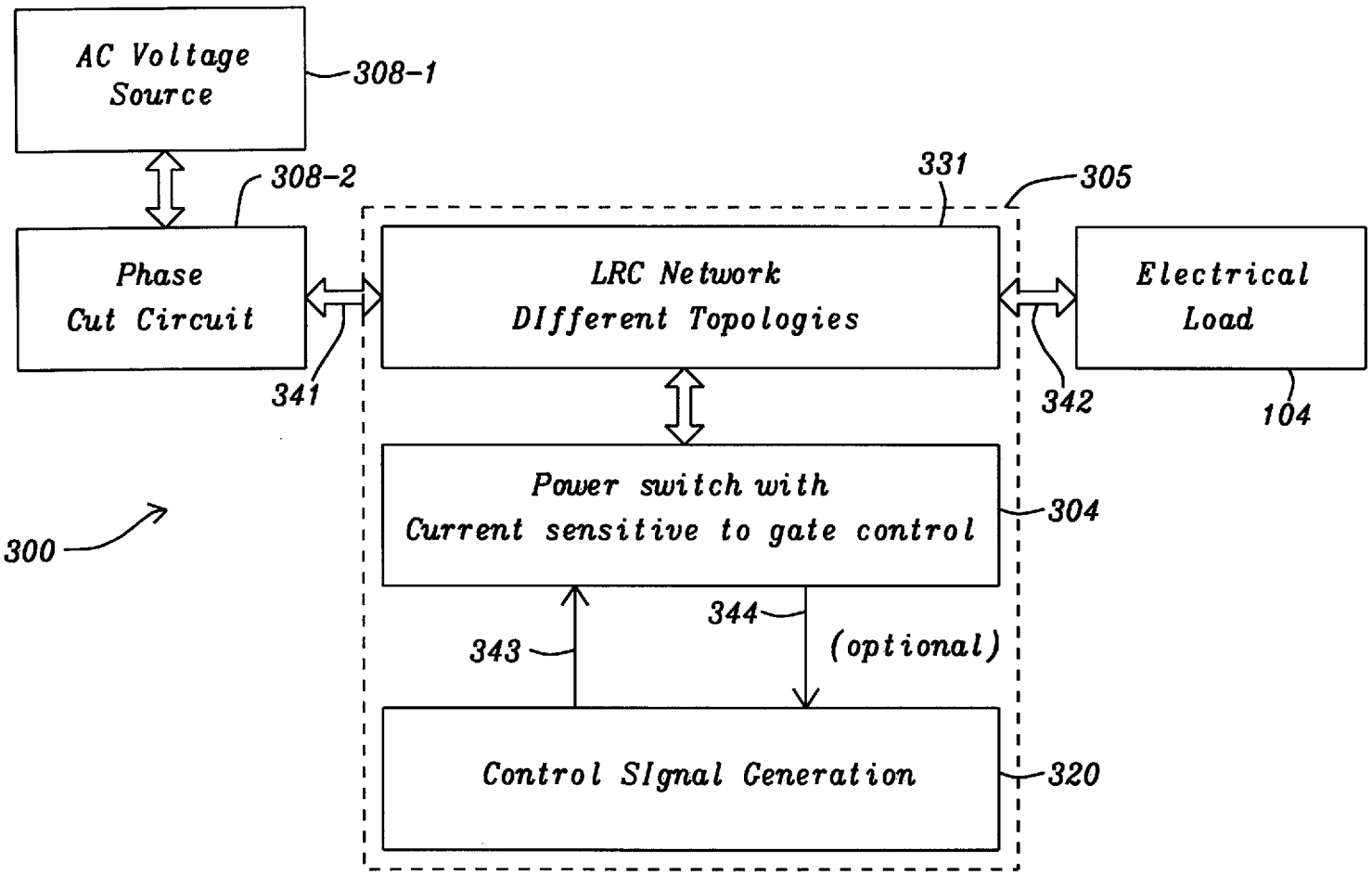
Figure 3B:
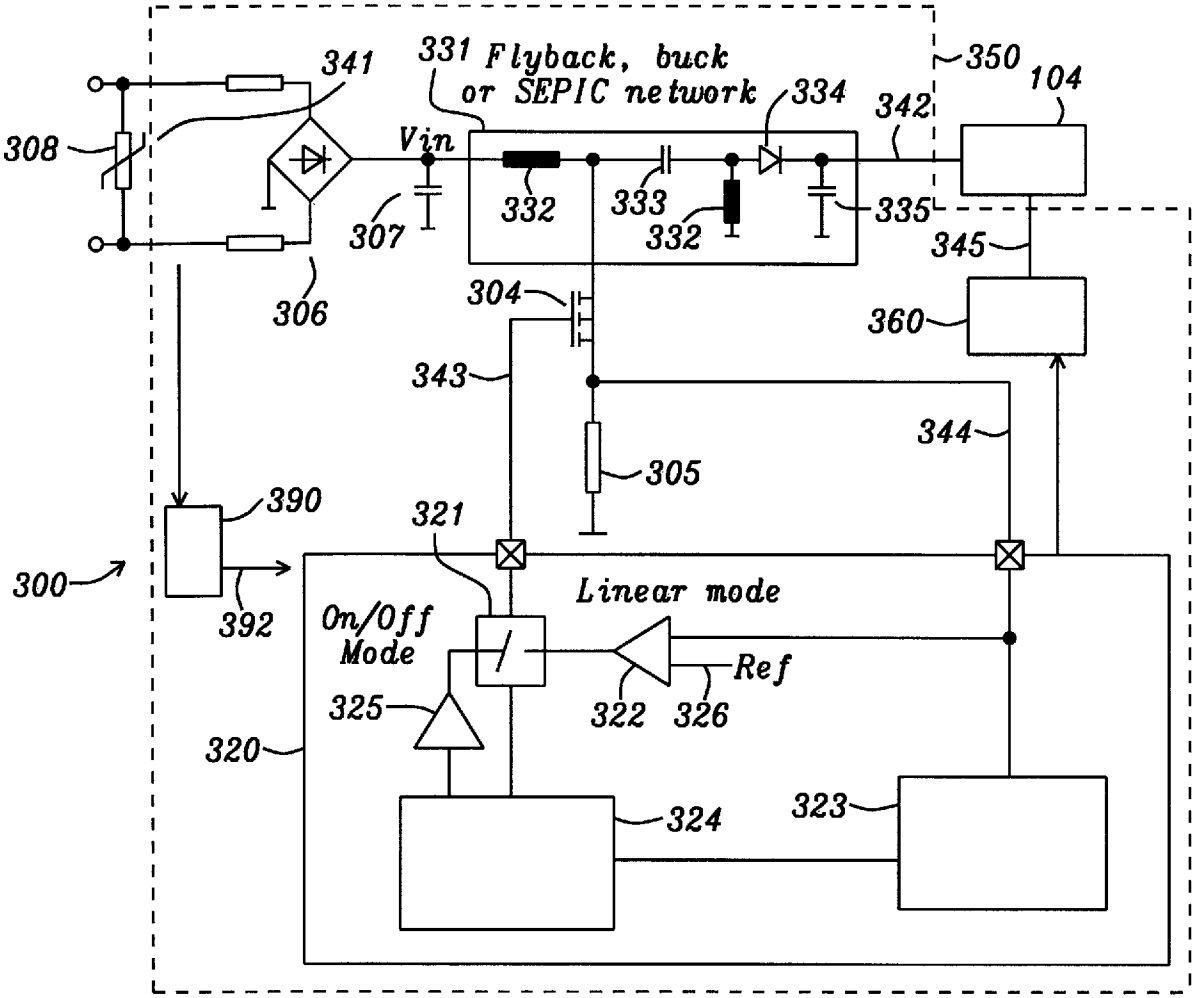
Figure 3C:
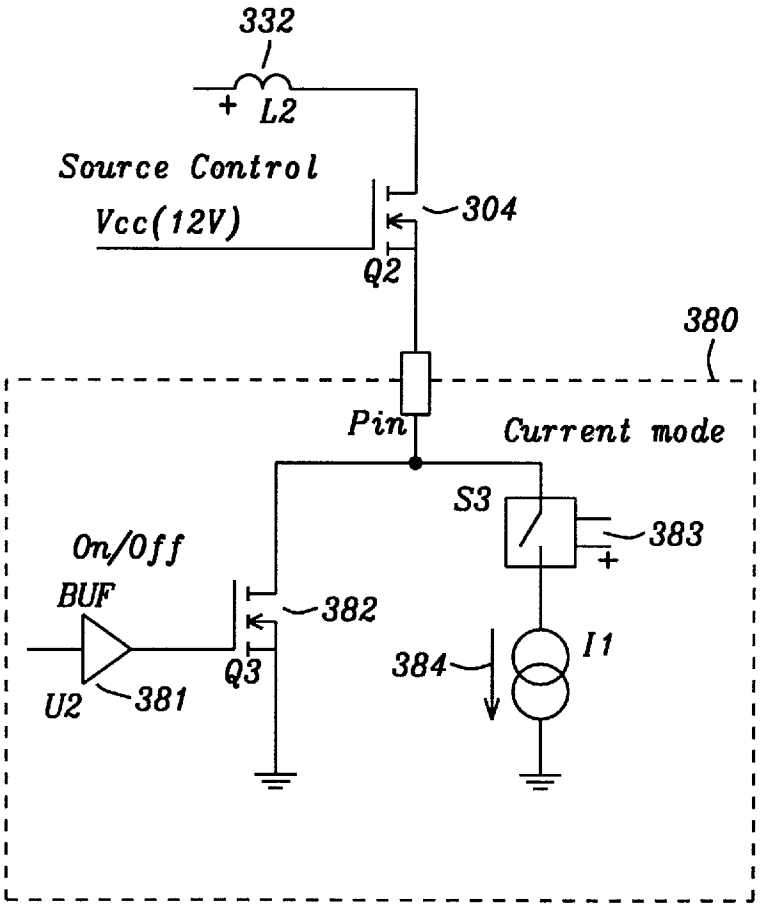
Figure 3C:
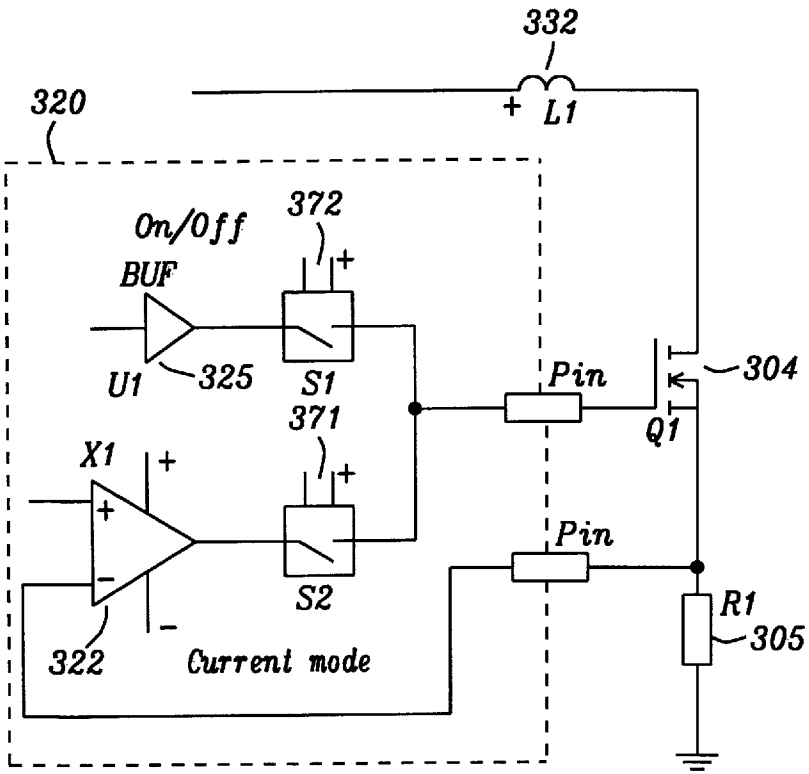
Figure 4A:
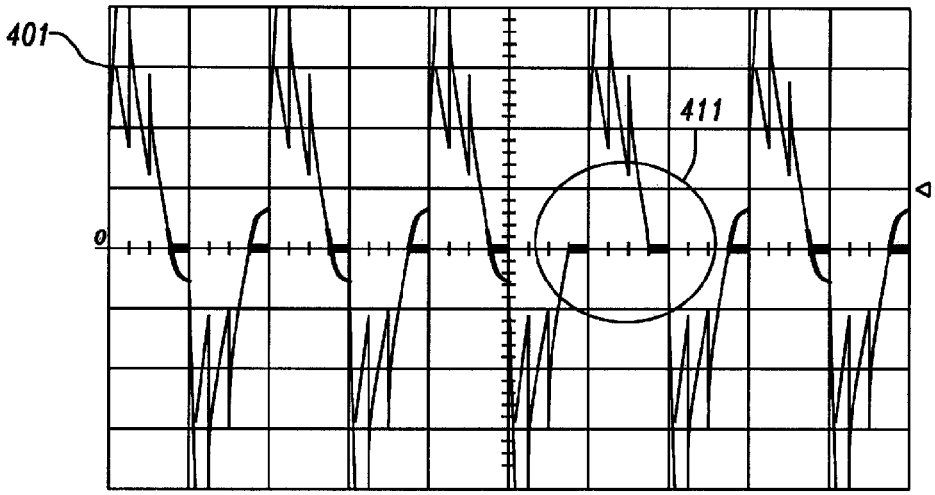
Figure 4B:
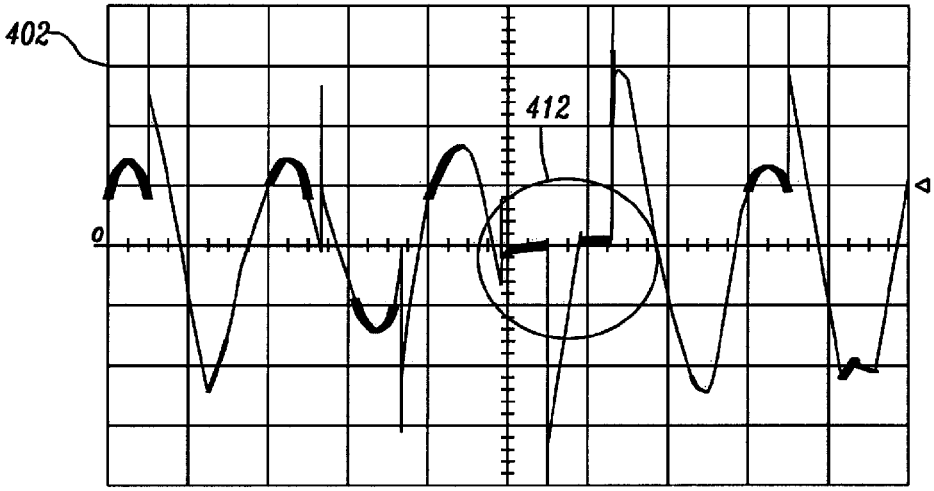
Figure 4C:
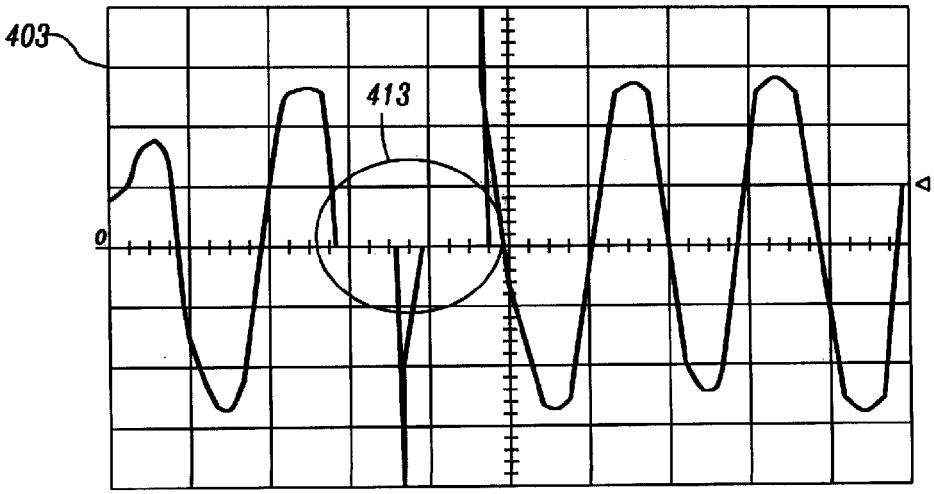

The disclosure is explained below in an exemplary manner with reference to the accompanying drawings, wherein FIG. 1 illustrates a block diagram of an example light bulb;

FIG. 2*a* illustrates example power supply arrangements for an LED lamp;

FIGS. 2*b*, 2*c* and 2*d* illustrate example input voltage waveforms;

FIG. 3*a* shows a block diagram of an example system for operating SSL lamps using phase-cut dimmers;

FIG. 3*b* shows a block diagram of an example driver circuit for an SSL lamp;

FIG. 3*c* shows block diagrams of example control units of a driver circuit for a 5 SSL lamp;

FIGS. 4*a*, 4*b* and 4*c* illustrate example input voltage waveforms for the example driver circuit of FIG. 3*b*; and.

Figure 5:
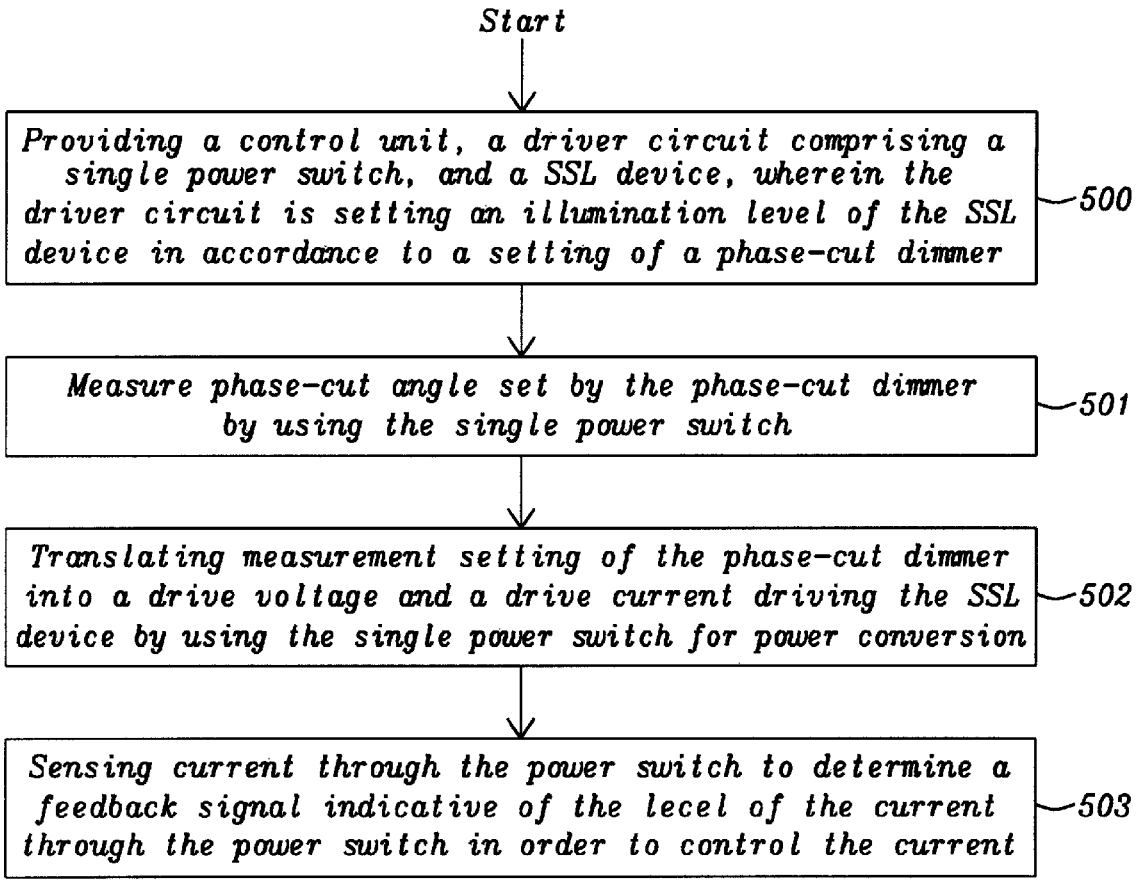

FIG. 5 shows a flowchart of a method allowing a reliable determination of the phase of a mains power submitted to a phase-cut dimmer, thereby reliably and efficiently controlling the illumination of a Solid State Lightening (SSL) lamp.

DETAILED DESCRIPTION

In the present document, a light bulb "assembly" includes all of the components required to replace a traditional incandescent filament-based light bulb, notably light bulbs for connection to the standard electricity supply. In British English (and in the present document), this electricity supply is referred to as "mains" electricity, whilst in US English, this supply is typically referred to as power line.

Other terms include AC power, line power, domestic power and grid power. It is to be understood that these terms are readily interchangeable, and carry the same meaning.

Typically, in Europe electricity is supplied at 230-240 VAC, at 50 Hz and in North 20 America at 110-120 VAC at 60 Hz. The principles set out in the present document apply to any suitable electricity supply, including the mains/power line mentioned, and a DC power supply, and a rectified AC power supply.

FIG. 1 is a schematic view of a light bulb assembly. The assembly 1 comprises a bulb housing 2 and an electrical connection module 4. The electrical connection module 4 can be of a screw type or of a bayonet type, or of any other suitable connection to a light bulb socket. Typical examples for an electrical connection module 4 are the E11, E14 and E27 screw types of Europe and the E12, E17 and E26 screw types of North America. Furthermore, a light source 6 (also referred to as an illuminant) is provided within the housing 2. Examples for such light sources 6 are a CFL tube or a solid state light source 6, such as a light emitting diode (LED) or an organic light emitting diode (OLED) (the latter technology is referred to as solid state lighting, SSL). The light source 6 may be provided by a single light emitting device, or by a plurality of LEDs.

Driver circuit 8 (also referred to as power supply arrangement in the present document) is located within the bulb housing 2, and serves to convert supply electricity received through the electrical connection module 4 into a controlled drive current for the light source 6. In the case of a solid state light source 6, the driver circuit 8 is configured to provide a controlled direct drive current to the light source 6.

The housing 2 provides a suitably robust enclosure for the light source and drive components, and includes optical elements that may be required for providing the desired output light from the assembly. The housing 2 may also provide a heat-sink capability, since management of the temperature of the light source may be important in maximizing light output and light source life. Accordingly, the housing is typically designed to enable heat generated by the light source to be conducted away from the light source, and out of the assembly as a whole.

In order to make an SSL based lamp compatible with phase-cut dimmers, the power supply arrangement 8 for such an SSL based lamp 1 may provide e.g. the following functions:

1. Take energy from the mains voltage set by the dimmer.
2. Filter any voltage fluctuation at the mains supply in order to keep the light output free of flicker.
3. Adjust the SSL lamp current/power (and by consequence the intensity of the emitted light) to the requested dim level.

The present document describes methods and systems which allow for the implementation of one or more of the above mentioned functions. In the following, such methods and systems will be described in the context of LED lamps. It should be noted, however, that the methods and systems described herein are equally applicable to controlling the power provided to other types of illumination technologies such as other types of SSL based lamps (e.g. OLEDs).

FIG. 2*a* illustrates a block diagram of a power supply arrangement 100 which may be used to control the power for illuminating the LED 104 based on the power provided by the mains power supply. The power supply arrangement 100 receives an input power 111 from the mains supply. The input power 111 may have been adjusted using a dimmer. Various types of dimmers exist, but the most frequently used type of dimmer is a so-called thyristor dimmer or phase-cut dimmer.

Thyristor dimmers switch on at an adjustable time (phase angle) after the start of each alternating current half-cycle, thereby altering the voltage waveform applied to lamps and so changing its root mean squared (RMS) effective voltage value. Because thyristor dimmers switch part of the voltage supplied (instead of absorbing it), there is very little wasted power at the dimmer. Dimming can be performed almost instantaneous and is easily controlled by remote electronics. Typically, TRIACs (Triode for Alternating Current) are used as thyristors within the dimmers in domestic lightening application. Variants of dimmers are leading edge phase-cut dimmers, tailing edge phase-cut dimmers or intelligent dimmers configured to switch between leading edge and tailing edge phase-cut. The methods and systems described herein are applicable to any of the above mentioned variants of dimmers.

As such, phase-cut dimmers are typically configured to remove a particular phase of the sinusoidal mains voltage. This leads to a reduction of the RMS voltage supplied to conventional incandescent lamp, thereby reducing the intensity of the light emitted by the incandescent lamp. On the other hand, energy efficient illumination technologies such as LED or OLED require a pre-determined level of direct current (DC) voltage, such that the modifications to the sinusoidal mains voltage performed by the dimmer cannot be directly used for modifying the intensity of the emitted light. Consequently, power supply arrangements or driver circuits for such energy efficient lamps typically comprise means for converting the phase-cut input voltage into an appropriately reduced power for the illuminant (e.g. the LED or OLED).

Returning now to the example power supply arrangements or driver circuit 100 of FIG. 2*a*. The example power supply arrangement 100 comprises a phase-cut angle detection unit 102 which senses the input voltage 112 and which estimates the angle at which the original sinusoidal mains voltage has been cut by the dimmer. The estimated angle 113 indicates a desired dim level and is passed to an LED control unit 103 which controls the LED power supply 101 via a control signal 114 to provide an output power 115 to the LED 104 (referred to as light source 6 in FIG. 1) which drives the LED 104 to provide light 116 at the desired dim level.

FIGS. 2*b*, 2*c* and 2*d* illustrate example waveforms 201, 202, 203 of input voltage waveforms 112. The illustrated waveforms 201, 202, 203 are typical voltage waveforms for incandescent light bulbs when used with a leading edge phase-cut dimmer. The respective "conduction angles" 211, 212, 213 of the dimmer are a function of the potentiometer turn angle which controls the average power delivered to the incandescent light bulbs. Due to a large power load of typical incandescent light bulbs, the dimmer fires within every mains period. The phase-cut angle 211 (also referred to as the "conduction angle" because it indicates the angle at which the phase-cut dimmer goes to an on-state, i.e. starts conducting) indicates a 100% angle setting with a maximum amount of power delivered to the light bulb, the phase-cut angle 212 indicates a 50% angle setting with a medium amount of power delivered to the light bulb and the phase-cut angle 213 indicates a 0% angle setting with a minimum amount of power delivered to the light bulb.

This is different when using low power loads such as SSL light bulb assemblies. Typical phase-cut dimmers only perform correctly when having a resistive load connected to them, which consumes a pre-determined minimum amount of power (as e.g. a conventional incandescent lamp of at least 40 W). When being used for dimming energy efficient LED lamps (at power levels in the range of 2 to 10 W), the input voltage waveform 112 generated by typical phase-cut dimmers may be significantly distorted. Distortions to the input voltage waveform may be due to effects such as multi firing, capacitive phase shift, and discontinuous operation of the dimmers. Example waveforms 401, 402, 403 of input voltages to a driver circuit are illustrated in FIGS. 4*a*, 4*b* and 4*c*. The waveform 401 corresponds to a 100% angle setting for which a maximum amount of power is to be delivered to the light source 6, 104, the waveform 402 corresponds to a 50% angle setting for which a medium amount of power is to be delivered to the light source 6, 104 and the waveform 403 corresponds to a 0% angle setting for which a minimum amount of power is to be delivered to the light source 6, 104. It can be seen that at the 100% angle setting, the dimmer performs multi-firing, that at the 50% angle setting, the dimmer is firing randomly and that at the 0% angle setting, the dimmer may not operate at all.

As a consequence, the settings of a phase-cut dimmer (and the corresponding desired illumination level) may not be easily derivable from the waveforms 401, 402, 403 of the input voltage to a drive circuit of a low load SSL device 104. The present document therefore addresses the technical problem of efficiently and reliably determining the phase-cut angle (i.e. the "conduction angles" 211, 212, 213) from the input voltage waveforms shown in FIGS. 4*a*, 4*b* and 4*c*. In particular, the present document describes a method and apparatus which make use of a discharge of capacitive voltage levels at a mains terminal, thereby resetting the input voltage in phases where a phase-cut dimmer is in off-mode. The discharge of the capacitive voltage levels may be used to determine the phase-cut angle, and the determined phase-cut angle may be used to set the degree of illumination of the light source 6, 104 (e.g. of the SSL device 104).

As outlined above, SSL based light bulb assemblies 1 which are compatible with phase-cut dimmers should e.g. be configured to

- maintain a defined and reliable mode of operation of the dimmer;
- filter any voltage fluctuations at the mains supply, in order to keep the light output 116 of the light bulb assembly 1 free of any flicker; and
- detect the momentary phase-cut angle and to adjust the light level according to the detected phase-cut angle.

The present document deals with the problem of detecting the phase-cut angle under various conditions of the light bulb assembly. In order to measure the actual dimming phase-cut angle, it is proposed to make use of a discharge current to reset the voltage across the mains input terminal of the light bulb assembly 1 (i.e. the input voltage) to zero in phases where the dimmer switching element (e.g. the TRIAC) is in its off-state. If no reset current is drawn, the voltage at the mains voltage terminal of the light bulb assembly discharges at a slow rate and no instantaneous voltage change is visible at the input. As a consequence, phase-cut angles are typically difficult to detect.

The discharge current may be selected to be large enough to ensure a proper discharge within a limited time window. In particular, the discharging should be terminated prior to the time instant when the dimmer switches on, thereby enabling the detection of the phase-cut angle. Furthermore, the discharge current should not contribute to the energy intake of the power converter from the mains supply, in order to avoid any light output modulation or excess voltage increase in the power converter. In other words, the energy intake of the power converter may be decoupled from the discharge current, thereby avoiding modulations of the drive current and/or drive voltage supplied to the light source 6, 104. Furthermore, the discharge current may be limited to a maximum value in order to avoid an overstress of components within the light bulb assembly 1 and in particular within the driver circuit of the light bulb assembly.

FIG. 3*a* shows a block diagram of an example system 300 for controlling the dim 30 state of an SSL device 104. The system 300 comprises an AC voltage source 308 1, e.g. the mains voltage. The AC voltage provided by the AC voltage source 308-1 is modified by a dimmer (e.g. a phase-cut dimmer) 308-2 to provide a phase-cut AC voltage (as illustrated in FIGS. 2 *c, d* and *e* and in FIGS. 4 *a, b*, and *c*). The phase-cut AC voltage is referred herein as the input voltage 341. Furthermore, the system 300 comprises a driver circuit 30, wherein the driver circuit 350 comprises an LRC network or power converter network 331.

The power converter network 331 is used (in conjunction with a power switch 304) to convert the input voltage 341 into a drive voltage 342. The power converter network 331 may e.g. be a flyback, buck or SEPIC power converter network. The drive voltage 342 is typically controlled to be a constant DC voltage which corresponds to (or exceeds) the on-voltage of the SSL device 104. Furthermore, the driver circuit 350 typically comprises a current source (not shown) to provide a drive current to the SSL device 104. The drive current is typically a DC current which may be maintained at a predetermined constant level, wherein the predetermined constant level corresponds to a predetermined illumination level of the SSL device 104. By increasing the constant level of the drive current, the illumination level of the SSL device 104 may be increased and vice versa. The current source may e.g. comprise a transistor (e.g. a FET) operated in a linear mode.

The power converter network 331 may be controlled using a power switch 304 (e.g. a transistor such as a field effect transistor, FET, a MOSFET (Metal Oxide Semiconductor FET), a PBJT (P-type Bipolar junction transistor) or an IGBT (Insulated gate bipolar transistor)). The power switch 304 may be operated according to at least two different modes. In a first mode (e.g. a switched mode or an on/off mode), the power switch 304 may control a voltage conversion ratio of the power converter network 331. In a second mode (e.g. a linear mode), the power switch 304 may be used to determine the phase-cut angle of the input voltage 341, thereby determining the desired illumination level of the SSL device 104. A control unit 320 may be used to control the mode of the power switch 304 via a control signal 343. Furthermore, the control unit 320 may receive a feedback signal 344 from the power switch 304, wherein the feedback signal 344 may be used to determine the phase-cut angle.

In other words, the gate control signal 343 may be used during a first time interval to operate the power switch 304 in a first mode by turning the power switch 304 on/off at a relatively high switching rate (e.g. in the range of 100 kHz). As a result, the power converter network 331 operates in an energy transfer mode. Furthermore, the gate control signal 343 may be used during a second time interval (different from the first time interval) to operate the power switch 304 in a linear mode, in order to allow for the determination of the phase-cut angle. When operated in the linear mode, the power switch 304 may provide a discharge current at the input terminals of the driver circuit 350 to reset any capacitive voltage. The discharge current acts as a load to the dimmer 308-2, thereby allowing for a stable operation of the dimmer 308-2. The stable operation of the dimmer 308-2 allows for a reliable determination of the phase-cut angle.

Once the phase-cut angle has been determined, a current source (not shown) of the system 300 may be controlled (e.g. by the control unit 320) to inject a constant drive current into the SSL device 104, wherein the constant drive current depends on the determined phase-cut angle. Typically, the drive current is decreased if the phase-cut angle increases and vice versa. As a result, the illumination level of the SSL device 104 decreases as the phase-cut angle increases and vice versa. The current source is typically arranged in series to the SSL device 104, thereby allowing for a direct control of the current through the SSL device 104.

Overall, the system 300 may comprise a constant AC voltage power source 308-1, a phase-cut dimmer 308-2, an LRC network 331, which typically depends on the used power topology, and a switch 304. The switch 304 may implement—in combination with the LRC network 331—a switched-mode power supply converter stage. Furthermore, the system 300 may comprise a gate control signal generation unit 320 which is configured to generate a gate control signal 343 for controlling an operating mode of the switch 304. In addition, the system 300 comprises an electrical load 104, e.g. an SSL device. The gate control signal 343 may be set to turn the switch 304 on/off at a commutation cycle rate, in order to convert mains power from the source 308-1 into power suitable for the electrical load 104. At selected time intervals, the control unit 320 may set the gate control signal 343 to a controlled level such that a defined current through the switch 304 is established. This current through the switch 304 may be used to reset the input voltage 341 during a phase of the input voltage 341, where the dimmer 308-2 is turned off. The resetting of the input voltage 341 allows for a reliable detection of the actual phase-cut angle from the input voltage 341.

During the first mode (e.g. during the switching mode), the switch 304 may be turned on/off at relatively high frequencies (in the range of 100 kHz) and/or at a selected duty cycle, thereby providing a desired voltage conversion ratio. When operated in the first mode, the power converter network 331 may be configured to continuously transfer power to the load 104.

At the selected time intervals, the gate control signal 343 may be set to a level which is suitable for establishing a defined current through the switch 304, in order to reset the input voltage 341. The current through the switch 304 may be set to an absolute and/or constant value by the use of an absolute and/or constant value of the gate control signal 343. By use of the above mentioned gate control signal 343, the switch 304 is operated in the second mode (e.g. in the linear mode). The switch 304 may be kept in an on-state until it is detected that the input voltage 341 exceeds a pre-determined input voltage threshold. The increase of the input voltage 341 is typically due to the dimmer 308-2 turning on its phase.

Hence, the substantial increase of the input voltage 341 is an indication of the phase-cut angle. As a result of the detection of a substantial increase of the input voltage 341, the control unit 320 may generate a control signal 343 to operate the switch 304 in its first mode. In more general term, the control signal 343 may be determined based on the input voltage 341.

The driver circuit 300 may comprise input voltage measurement means (not shown) which are configured to determine a voltage derived from the input voltage 341. By way of example, the input voltage measurement means may comprise a voltage divider which couples the input voltage 341 to the control unit 320. The control unit 320 may comprise an input voltage pin (not shown) for receiving the voltage derived from the input voltage 341. As such, the control unit 320 may be configured to detect that the input voltage 341 exceeds a predetermined input voltage threshold, based on the received voltage.

As outlined above, the switch 304 may be operated in the second mode (i.e. in the linear mode) when it is detected that the input voltage 341 is below the pre-determined input voltage threshold. Furthermore, the switch 304 may be operated in the first mode (i.e. in the on/off mode or in the pulse width modulated mode), when it is detected that the input voltage 341 is above the pre-determined input voltage. By way of example, the pre-determined input voltage threshold may be in the range of 20V (for a mains voltage in the range of 220V). In an embodiment, the pre-determined input voltage threshold is in the range of 10% of the mains voltage.

The phase-cut angle may be determined by measuring the time interval during which the input voltage 341 was detected to be low. The measured time interval may be stored, e.g. within the control unit 320. The measured time interval corresponds to the phase-cut angle. In particular, the phase-cut angle may be proportional to the measured time interval, wherein the proportionality factor depends on the mains frequency (e.g. 50 Hz or 60 Hz). In an embodiment, the phase-cut angle is determined as $a=180°*T*f$, wherein T is the measured time interval (in seconds), f is the mains frequency (in 1/second) and a is the phase-cut angle (measured in degrees). As such, the measured time interval may be taken as an indicator for the phase-cut angle. An intended dim level may be calculated based on the measured time interval and the power in the light source 104 may be set according to the calculated dim level. In particular, the current provided by a current source of the driver circuit 350 may be set in accordance to the calculated dim level.

Overall, it should be noted that the system 300 only makes use of a single switch 304 to provide at least two functions, i.e. a power conversion function and a phase-cut angle measurement function. The at least two functions of the single switch 304 may be implemented by sequentially operating the switch 304 in at least two different modes, wherein the switch 304 provides a power conversion function when operated in the first mode and wherein the switch 304 provides a phase-cut angle measurement function when operated in the second mode. Furthermore, it should be noted that the control unit 320 only comprises a single pin for the control of the single switch 304. In addition, the control unit 320 may comprise a pin for receiving the feedback signal 344. As a consequence, the number of pins of the control unit 320 can be reduced compared to a control unit 320 which controls a plurality of switches. In an embodiment, the control unit only comprises two pins (for the control signal 343 and for the feedback signal 344, respectively). As a result of using only a single switch 304 and/or of reducing the number of pins, the cost of the driver circuit 300 and/or of the control unit 320 can be reduced.

FIG. 3*b* illustrates an example system 300 for controlling the illumination level of an SSL device 104 based on a dimmer controlled input voltage 341 in more detail. The input voltage 341 is provided by a mains voltage power supply in combination with a dimmer (combined reference numeral 308). A driver circuit 350 is used to generate a drive voltage 342 and a drive current 345. The drive voltage 242 is typically a substantially constant voltage corresponding to the onvoltage of the SSL device 104.

The drive current 345 is typically a substantially constant current set in accordance to an intended illumination level of the SSL device 104. The driver circuit 350 may comprise a rectifier unit 306 configured to provide a rectified version of the input voltage 341. The rectifier unit 306 may comprise a half-wave or a full-wave rectifier. Furthermore, the rectifier unit 306 may comprise EMI (electromagnetic interference) filter components. Typically, the rectifier unit 306 is used in conjunction with a stabilizing capacitor 307 which is used to smooth the rectified input voltage.

Furthermore, the driver circuit 350 typically comprises a power converter network 331. In the illustrated example, the power converter network 331 is a SEPIC (Single-Ended Primary-Inductor Converter) network comprising the coils 332, the capacitors 333, 335 and the diode/switch 334. The power converter network 331 may implement—in combination with the switch 304—a switched-mode power converter configured to transfer energy from the input voltage 341 to the load 104. In particular, the power converter 331, 304 may be operated such that the rectified input voltage is converted into a substantially constant drive voltage 342 for the SSL device 104.

As outlined above, the switch 304 may be operated in a first mode (also referred to as the on/off mode) where the switch 304 is alternated between its on-state and its off-state at a predetermined commutation cycle rate and at a predetermined duty cycle (wherein the duty cycle defines the fraction of the on-state within a commutation cycle). The commutation cycle rate and the duty cycle may be used to control the conversion ratio of the power converter 331, 304. Furthermore, the switch 304 may be operated in a second mode (also referred to as the linear mode) where the switch 304 is controlled to allow for a predetermined drain-source current through the switch 304. The current through the switch 304 may be used, to reset the (rectified) input voltage 341. In particular, the current through the switch 304 may be used to discharge the stabilizing capacitor 307, thereby enabling access to the "unsmoothed" (rectified) input voltage 341 and thereby enabling a reliable measurement of the phase-cut angle.

The first and second mode of the switch 304 may be controlled via the gate control signal 343 generated by the control unit 320. The control unit 320 may comprise a mode selector 321 which is configured to switch between a first control signal generation unit 325 configured to generated the gate control signal 343 for the first mode of the switch 304 and a second control signal generation unit 322 configured to generate the gate control signal 343 for the second mode of the switch 304. A control logic 324 may be used to control the mode selector 321 based on the feedback signal 344, wherein the feedback signal 344 may be indicative of the current through the switch 304. By way of example, the current through the switch 304 may be sensed by a sensing resistor 305, thereby providing a voltage drop at the sensing resistor 305 which is proportional to the current through the switch 304. In the illustrated example, the feedback signal 344 corresponds to the voltage drop across the sensing resistor 305 and is therefore proportional to the current through the switch 304.

In order to operate the switch 304 in the first mode, the control logic 324 sets the mode selector 321 such that the gate of the switch 304 is coupled to the first control signal generation unit 325 which comprises e.g. an operational amplifier. Furthermore, the control logic 324 may be configured to provide a pulse width modulated signal which is converted by the first control signal generation unit 325 into a gate control signal 343 which puts the switch 304 into alternating on/off states at the pre-determined commutation cycle rate and at the pre-determined duty cycle.

In order to operate the switch 304 in the second mode, the control logic 324 sets the mode selector 321 such that the gate of the switch 304 is coupled to the second control signal generation unit 322 which comprises e.g. a comparator. The comparator may be used to implement a feedback loop using the feedback signal 344, thereby determining the gate control signal 343 such that the feedback signal 344 corresponds to a pre-determined reference signal 326. In particular, the gate control signal 343 may be determined such that the current through the switch 304 corresponds to a pre-determined discharge current. The pre-determined discharge current may be selected such that the components of the driver circuit 350 (notably of the power converter network 331 and of the rectifier 306) are protected from overstress and/or that the discharging is performed within a pre-determined discharge time interval. Typically, the pre-determined discharge current will be determined based on a compromise between overstress protection and discharge time interval. By way of example, the pre-determined discharge current may be in the range of 10 mA or 100 mA.

The control unit 320 may further comprise a feedback processing module 323 configured to analyze the feedback signal 344. The feedback processing module 323 may be configured to determine that the feedback signal 344 exceeds a predetermined feedback threshold. This situation may be indicative of the fact that the dimmer 308-1 goes into on-state, thereby providing an input voltage 341 with a magnitude greater than a pre-determined input voltage threshold (e.g. zero). In other words, this situation may be indicative of a phase-cut angle within the input voltage 341. The feedback processing module 323 may indicate this situation to the control logic 324.

The control logic 324 may determine a phase-cut time interval indicative of the phase-cut angle. The phase-cut time interval may correspond to the time interval between the time instant when the switch 304 was put into the second mode and the time instant when the feedback processing module 323 detected the feedback signal 344 exceeding the pre-determined feedback threshold (i.e. the time instant when the dimmer 308-2 switches on). Furthermore, the control logic 324 may control the switch 304 to be operated in the first mode, subject to the feedback processing module 323 detecting that the feedback signal 344 exceeds the predetermined feedback threshold. In other words, if it is detected that the dimmer 308-2 switches on, the control logic 324 may control the mode selector 321 to put the switch 304 into the first mode.

Furthermore, the driver circuit 300 of FIG. 3*b* may comprise input voltage measurement means 390 (e.g. a voltage divider). The input voltage measurement means 390 may be configured to provide a voltage 392 derived from the input voltage 341 to the control unit 320. The control unit 320 may comprise a pin to receive the voltage 392.

FIG. 3*c* illustrates block diagrams of example control units 320, 380 for a driver circuit 300. The control unit 320 of FIG. 3*c* corresponds to the control unit 320 shown in FIG. 3*b*. Furthermore, the control unit 320 of FIG. 3*c* comprises a switch 372 configured to provide the pulse width modulated control signal to the switch 304, for operating the switch 304 in an on/off mode. In addition, control unit 320 of FIG. 3*c* comprises a transistor 371 configured to control the gate control signal 343 of the switch 304, thereby controlling the current through the switch 304.

FIG. 3*c* (right hand side) shows a block diagram of an example control unit 380 which may be used in conjunction with a source-controlled switch 304. In this case, the switch 304 may have the function of a level shifter which is controlled via its source. The switch 304 of FIG. 3*c* (right hand side) is coupled to a supply voltage Vcc (e.g. Vcc=12V). The control unit 380 comprises a first branch comprising a PWM driver 381 and a PWM control switch 382 operated in an on/off mode. Furthermore, the control unit 380 comprises a second branch comprising a switch 383 and a current source 384. The first branch may be used to operate the switch 304 in the first mode (i.e. in the on/off mode). The second branch may be used to operate the switch 304 in the second mode (i.e. in the linear mode). The current through the switch 304 may be fixed using the current source 384. When operated in the second mode, the switch 382 of the first branch may be kept in an off state. On the other hand, when operated in the first mode, the switch 383 may be kept in an off state. The control unit 380 may be advantageous as it does not comprise a control loop, and/or as it makes use of a reduced number of pins.

It should be noted that in the case of the example control unit 380 of FIG. 3*c* (right hand side) an indication of the input voltage 341 may be measured at the pin of the control unit 380, i.e. at the source of the switch 304. In particular, it may be measured that the voltage at the drain of the switch 304 drops below the supply voltage Vcc. Furthermore, it may be measured that the current source 384 is saturated. As such, the cycle of the mains voltage may be detected at the pin of the control unit 380.

FIGS. 4*a*, 4*b*, and 4*c* illustrate typically waveforms of the input voltage 341 in the system 300 of FIG. 3*b*. As indicated above, phase-cut dimmers 308-2 are typically not designed to work with power converters 304, 331 which attempt to regulate a constant power (i.e. a constant drive voltage 342 and a constant drive current 345) to a relatively low load, independent of the phase angle and input voltage. In order to implement a dimmable power converter for an SSL device 104, it is proposed to sense the conduction phase angle of the input voltage 341. FIGS. 4*a*, 4*b* and 4*c* show the waveforms 401, 402, 403 of the input voltage 341 in the system 300 of FIG. 3*b*. The waveform 401 corresponds to a 100% angle setting, the waveform 402 corresponds to a 50% angle setting and the waveform 403 corresponds to a 0% angle setting. It can be seen that during power conversion operation (when the switch 304 is operated in the first mode), the waveform 401, 402, 403 of the input voltage 341 is significantly distorted due to multi-firing, random firing and/or non-firing of the dimmer 308-2. As outlined above, the unstable behavior of the dimmer 308-2 is typically due to the low load provided by the SSL device 104.

On the other hand, it can be seen that phase-angles can be reliably detected, when applying the discharge current in the phase where the dimmer is in off-state. FIGS. 4*a*, 4*b*, and 4*c* identify respective time intervals 411, 412, 413 where the switch 304 is operated in the second (e.g. linear) mode to provide a discharge current. The discharge current represents a load to the dimmer 308-2, thereby allowing for a reliable operation of the dimmer 308-2. In particular, the operation of the switch 304 in the second mode allows for a reliable operation of the dimmer 308-2 in the off-state and a reliable transition from the off-state of the dimmer 308-2 to the on-state of the dimmer 308-2. Hence, the phase-cut angle can be reliably detected within the driver circuit 350, e.g. within the control unit 320. In particular, the phase-cut angle may be determined based on the feedback signal 344.

The waveforms 401, 402, 403 of the input voltage 341 during the time intervals 411, 412, 413 may also be used to reliably measure and synchronize with the mains period. In case of a leading edge phase-cut dimmer 308-2, the transition from an on-state of the dimmer 308-2 to an off-state (possibly in combination with the condition that a length of the off-state exceeds a pre-determined minimum length) may be a reliable indication of the beginning of a new (half) cycle of the mains power supply (i.e. of a zero-crossing of the mains power supply). Consequently, the time intervals 411, 412, 413 during which the switch 304 is operated in the second mode may be used to synchronize the driver circuit 350 with the cycle of the mains supply. By doing this, it can be ensured that the selection of the first and second modes of the switch 304 is synchronized with the mains supply. In particular, it can be ensured that the second mode is activated while the dimmer 308-2 is (supposed to be) in off-state (e.g. at the beginning of a cycle of the mains supply).

As indicated above, the current through the switch 304, when operated in the second mode, represents a load to the dimmer 308-2. As such, the driver circuit 350 may incur power losses when the switch 304 is operated in the second mode. In other words, the determination of the phase-cut angle may be linked to power losses. In order to reduce such power losses, the measurement of the phase-cut angle may be performed at a measurement rate which is lower than the cycle rate of the mains supply, e.g. by a factor of 10 or 100.

The power converter network 331 and the current source 360 may be configured 30 such that time intervals during which the switch 304 is operated in the second mode can be bridged without impacting the (constant) drive voltage 342 and the (constant) drive current 345. This can be achieved e.g. by using appropriate capacitors 335 at the output of the power converter network 331 in order to supply the (constant) drive voltage 342 and by appropriately controlling the current source 360 (e.g. by controlling the gate voltage of a transistor comprised within the current source 360).

FIG. 5 shows a flowchart of a method allowing a reliable determination of the phase of a mains power submitted to a phase-cut dimmer, thereby reliably and efficiently controlling the illumination of a Solid State Lightening (SSL) lamp. A first step 500 depicts a provision of a control unit, a driver circuit comprising a single power switch, and a SSL device, wherein the driver circuit is setting an illumination level of the SSL device in accordance to a setting of the phase-cut dimmer. The next step 501 shows measuring a phase-cut-angle set by the phase-cut dimmer by using the single power switch. Step 502 illustrates translating measured setting of the phase-cut dimmer into a drive voltage and a drive current driving the SSL device by using the single switch for power conversion. Finally step 503 depicts sensing current through the power switch to determine a feedback signal indicative of the level of the current through the SSL in order to control the current.

In the present document, a driver circuit for an SSL device has been described which is configured to set an illumination level of the SSL device in accordance to a setting of a phase-cut dimmer. For this purpose, the driver circuit makes use of a power switch which is operated in at least two different modes, in order to allow for power conversion and for a reliable measurement of the setting of the phase-cut dimmer, respectively. The measured setting of the phase-cut dimmer is translated by the driver circuit into a drive voltage and a drive current which provide a flicker-free illumination level of the SSL device, in accordance to the setting of the phase-cut dimmer. The use of a single switch for implementing a power conversion function and a measurement function leads to an efficient and cost effective driver circuit for SSL devices.

It should be noted that the description and drawings merely illustrate the principles of the proposed methods and systems. Those skilled in the art will be able to implement various arrangements that, although not explicitly described or shown herein, embody the principles of the disclosure and are included within its spirit and scope. Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the disclosure, as well as specific examples thereof, are intended to encompass equivalents thereof.

The invention claimed is:

1. A control unit for a driver circuit which is configured to drive a solid state lightening, referred to as SSL device, subject to an input voltage derived from a mains voltage using a phase-cut dimmer, wherein the driver circuit comprises a transistor operable in a first mode and in a second mode; and a power converter network; wherein the driver circuit further comprises current sensing means configured to determine a feedback signal indicative of the level of the current through the transistor; and wherein the control unit is configured to control the transistor to selectively operate in the first and second mode; wherein in the first mode, the transistor alternates between an on-state and an off-state at a commutation cycle rate, thereby providing a switched-mode power converter in conjunction with the power converter network; wherein in the second mode, the transistor is controlled via a gate control signal applied to the gate of the transistor so that it is traversed by a controlled current, thereby providing a controlled load to the mains voltage; and control the level of the current through the transistor, when in the second mode, by determining the gate control signal based on the feedback signal.

2. The control unit of claim 1, wherein the control unit is configured to control the transistor to change from the first mode to the second mode at a first time instant;

determine that the input voltage exceeds a pre-determined input voltage threshold at a second time instant, subsequent to the first time instant; and control a drive current through the SSL device based on the first and second time instants, thereby controlling an illumination level of the SSL device.

3. The control unit of claim 2, wherein the control unit is configured to receive a voltage derived from the input voltage; and wherein the control unit is configured to determine that the input voltage exceeds a pre-determined input voltage threshold by determining that the received voltage exceeds a pre-determined threshold.

4. The control unit of claim 2, wherein the control unit is configured to determine an indicator of a phase-cut angle set by the dimmer based on the time interval between the first and second time instants;

determine the illumination level corresponding to the phase-cut angle; and control the drive current providing the illumination level.

5. The control unit of claim 2, wherein the mains voltage is an alternating voltage at a mains frequency;

the control unit is configured to synchronize with the mains voltage;

the phase-cut dimmer is a leading edge phase-cut dimmer; and the first time instant corresponds to a zero-crossing of the mains voltage.

6. The control unit of claim 2, wherein during a startup phase, the control unit is configured to operate the transistor in the second mode for at least two half-waves of the mains voltage;

the control unit is configured to determine a time interval during which the input voltage is below the pre-determined input voltage threshold; and an edge of the time interval corresponds to a zero-crossing of the mains voltage.

7. The control unit of claim 2, wherein the control unit is configured to store data derived from the first and/or second time instants.

8. The control unit of claim 1, wherein the mains voltage is an alternating voltage at a mains frequency;

the control unit is configured to periodically put the transistor in the second mode at a measurement frequency; and the measurement frequency is smaller than the mains frequency.

9. The control unit of claim 1, wherein the control unit is configured to control the commutation cycle rate and/or a duty cycle of the transistor, when in the first mode.

10. A driver circuit for driving a solid state lightening, referred to as SSL, device, subject to an input voltage derived from a mains voltage using a phase-cut dimmer, the driver circuit comprising a transistor operable in a first mode and in a second mode; wherein in the first mode, the transistor alternates between an on-state and an off-state at a commutation cycle rate; wherein in the second mode, the transistor is controlled via a gate control signal applied to the gate of the transistor so that it is traversed by a current at a smoothly controllable level;

a power converter network configured to provide a switched-mode power converter in conjunction with the transistor when operated in the first mode; wherein the power converter generates a drive voltage for the SSL device from the input voltage;

current sensing means configured to determine a feedback signal indicative of the level of the current through the transistor; and a control unit configured to control the transistor to selectively operate in the first and second mode; wherein in the first mode, the transistor alternates between an on-state and an off-state at a commutation cycle rate, thereby providing a switched-mode power converter in conjunction with the power converter network; wherein in the second mode, the transistor is controlled so that it is traversed by a controlled current, thereby providing a controlled load to the mains voltage; and control the level of the current through the transistor, when in the second mode, by determining the gate control signal based on the feedback signal.

11. The driver circuit of claim 10, wherein the power converter network comprises a flyback network, a buck network and/or a SEPIC network; and/or the drive voltage provided by the power converter is maintained at least at an on-voltage of the SSL device.

12. The driver circuit of claim 10, further comprising a current source arranged in series to the SSL device and configured to provide a drive current for the SSL device subject to the control of the control unit.

13. The driver circuit of claim 10, further comprising a rectifier unit configured to rectify the input voltage;

input voltage sensing means configured to sense a voltage derived from the input voltage and configured to provide the sensed voltage to the control unit; and a stabilizing capacitor configured to stabilize the rectified input voltage to yield a voltage at an input of the power converter network.

14. The driver circuit of claim 10, wherein the control unit is configured to control the transistor to change from the first mode to the second mode at a first time instant;

determine that the input voltage exceeds a pre-determined input voltage threshold at a second time instant, subsequent to the first time instant; and control a drive current through the SSL device based on the first and second time instants, thereby controlling an illumination level of the SSL device.

15. The driver circuit of claim 14, wherein the control unit is configured to receive a voltage derived from the input voltage; and wherein the control unit is configured to determine that the input voltage exceeds a pre-determined input voltage threshold by determining that the received voltage exceeds a pre-determined threshold.

16. The driver circuit of claim 14, wherein the control unit is configured to determine an indicator of a phase-cut angle set by the dimmer based on the time interval between the first and second time instants;

determine the illumination level corresponding to the phase-cut angle; and control the drive current providing the illumination level.

17. The driver circuit of claim 14, wherein the mains voltage is an alternating voltage at a mains frequency;

the control unit is configured to synchronize with the mains voltage;

the phase-cut dimmer is a leading edge phase-cut dimmer; and the first time instant corresponds to a zero-crossing of the mains voltage.

18. The driver circuit of claim 14, wherein during a startup phase, the control unit is configured to operate the transistor in the second mode for at least two half-waves of the mains voltage;

the control unit is configured to determine a time interval during which the input voltage is below the pre-determined input voltage threshold; and an edge of the time interval corresponds to a zero-crossing of the mains voltage.

19. The driver circuit of claim 14, wherein the control unit is configured to store data derived from the first and/or second time instants.

20. The driver circuit of claim 10, wherein the mains voltage is an alternating voltage at a mains frequency;

the control unit is configured to periodically put the transistor in the second mode at a measurement frequency; and the measurement frequency is smaller than the mains frequency.

21. The driver circuit of claim 10, wherein the control unit is configured to control the commutation cycle rate and/or a duty cycle of the transistor, when in the first mode.

22. A light bulb assembly comprising an electrical connection module configured to electrically connect to a mains voltage submitted to a phase-cut dimmer, thereby providing an input voltage;

a driver circuit configured to provide a drive voltage and a drive current in accordance to a setting of the phase-cut dimmer, based on the input voltage the driver circuit comprising a transistor operable in a first mode and in a second mode; wherein in the first mode, the transistor alternates between an on-state and an off-state at a commutation cycle rate; wherein in the second mode, the transistor is controlled via a gate control signal applied to the gate of the transistor so that it is traversed by a current at a smoothly controllable level;

a power converter network configured to provide a switched-mode power converter in conjunction with the transistor when operated in the first mode; wherein the power converter generates a drive voltage for the SSL device from the input voltage;

current sensing means configured to determine a feedback signal indicative of the level of the current through the transistor; and a control unit wherein the control unit is configured to control the transistor to selectively operate in the first and second mode; wherein in the first mode, the transistor alternates between an on-state and an off-state at a commutation cycle rate, thereby providing a switched-mode power converter in conjunction with the power converter network; wherein in the second mode, the transistor is controlled so that it is traversed by a controlled current, thereby providing a controlled load to the mains voltage; wherein the control unit is further configured to control the level of the current through the transistor, when in the second mode, by determining the gate control signal based on the feedback signal; and a SSL device configured to provide light at an illumination level in accordance to the drive voltage and drive current.

23. The light bulb assembly of claim 22, wherein the power converter network comprises a flyback network, a buck network and/or a SEPIC network, and/or the drive voltage provided by the power converter is maintained at least at an on-voltage of the SSL device.

24. The light bulb assembly of claim 22 wherein the driver circuit further comprises a current source arranged in series to the SSL device and configured to provide a drive current for the SSL device subject to the control of the control unit.

25. The light bulb assembly of claim 22, wherein the control unit is configured to control the transistor to change from the first mode to the second mode at a first time instant;

determine that the input voltage exceeds a pre-determined input voltage threshold at a second time instant, subsequent to the first time instant; and control a drive current through the SSL device based on the first and second time instants, thereby controlling an illumination level of the SSL device.

26. The light bulb assembly of claim 22, wherein the control unit is configured to receive a voltage derived from the input voltage; and wherein the control unit is configured to determine that the input voltage exceeds a pre-determined input voltage threshold by determining that the received voltage exceeds a pre-determined threshold.

* * * * *